US006547519B2

(12) United States Patent
deBlanc et al.

(10) Patent No.: US 6,547,519 B2
(45) Date of Patent: Apr. 15, 2003

(54) BLOWER IMPELLER APPARATUS WITH PIVOTABLE BLADES

(75) Inventors: James J. deBlanc, Roseville, CA (US); David M. Dickey, Roseville, CA (US); Victoria Tsang Tam, Davis, CA (US)

(73) Assignee: Hewlett Packard Development Company, L.P., Houston, TX (US)

( * ) Notice: Subject to any disclaimer, the term of this patent is extended or adjusted under 35 U.S.C. 154(b) by 39 days.

(21) Appl. No.: 09/834,546

(22) Filed: Apr. 13, 2001

(65) Prior Publication Data

US 2002/0150463 A1 Oct. 17, 2002

(51) Int. Cl.[7] ..... F04D 29/30

(52) U.S. Cl. ..... 415/141; 416/143; 416/186 A; 416/88

(58) Field of Search ..... 416/87, 88, 89, 416/143, 186 A, 223 B; 415/141

(56) References Cited

U.S. PATENT DOCUMENTS

| | | | | |
|---|---|---|---|---|
| 387,138 A | | 7/1888 | Bruce | |
| 1,600,522 A | | 9/1926 | Strehlke | |
| 2,468,366 A | | 4/1949 | Habinski | |
| 2,738,124 A | | 3/1956 | Rosenberg | |
| 2,950,686 A | * | 8/1960 | Ledel et al. | 416/186 A |
| 3,479,947 A | | 11/1969 | Myers | |
| 3,856,432 A | | 12/1974 | Campagnuolo et al. | |
| 3,901,623 A | * | 8/1975 | Grennan | 416/186 A |
| 4,303,375 A | * | 12/1981 | Foglesong et al. | 416/167 |
| 4,540,337 A | | 9/1985 | Olsen | |
| 4,662,819 A | * | 5/1987 | Lakowske et al. | 415/192 |
| 4,900,227 A | | 2/1990 | Trouplin | |
| 5,620,306 A | * | 4/1997 | Day | 416/185 |

FOREIGN PATENT DOCUMENTS

| | | | |
|---|---|---|---|
| DE | 280189 | | 5/1913 |
| FR | 2254232 A | * | 8/1975 |

* cited by examiner

*Primary Examiner*—Ninh Nguyen

(57) ABSTRACT

Blower designs for vented enclosures include an impeller having a plurality of blades. The impeller includes a plurality of blades pivotably coupled to an impeller body. The blades pivot to enable operation in one of a closed and an open state. Air flow between blades is substantially restricted when the blades are in the closed state. Air flow between the blades is permitted when the blades are in an open state. In one embodiment, the pivotable couplings are spring loaded to maintain the blades in the closed state when the impeller rotational speed is below a threshold range. The blades pivot to the open state when the rotational speed exceeds the threshold range.

18 Claims, 6 Drawing Sheets

BLOWER IMPELLER APPARATUS WITH PIVOTABLE BLADES

FIELD OF THE INVENTION

This invention relates to the field of blowers. In particular, this invention is drawn to blower impeller designs.

BACKGROUND OF THE INVENTION

Cabinetry or enclosures for heat generating equipment may contain one or more blowers for active or forced air cooling. The blower displaces the air within the enclosure volume with cooler air external to the enclosure volume. The blower acts as a pump to transfer air between the two environments. Depending upon the configuration, either the air within the enclosure or the air external to the enclosure is the source for the pump. Air pumped from the interior by the blower is replaced with air external to the enclosure through the vents. Alternatively, air pumped from the exterior of the enclosure into the enclosure displaces the air in the enclosure through the vents. Without active cooling, the components within the cabinetry can overheat resulting in erratic, unpredictable behavior or a shortened lifespan among other maladies.

Blower systems may incorporate multiple blowers for redundancy or to achieve a specific air flow pattern in order to ensure adequate cooling. The failure of a single blower, however, creates a new source for air. Moreover, the blower interface between the internal/external environments tends to be more efficient for transferring air than the enclosure vents. The blower interface thus tends to become a preferential source relative to the vents for the transfer of air. As a result, the air flow patterns within the enclosure may be sufficiently disrupted to prevent adequate cooling or to significantly decrease the efficiency of redundant blower systems.

One approach uses baffles to prevent reverse airflow. These baffles have a number of members that pivot to enable opening and closing the baffle. When the blower is off, gravity or other forces close the baffle. During normal operation, simple baffles rely upon the pressure developed by the blower to open. One disadvantage of simple baffles for equipment enclosures is the additional assembly steps required to mount the baffles on the equipment. Another disadvantage of simple baffles is that the baffles members significantly impeded the flow of air from the blower exhaust.

SUMMARY OF THE INVENTION

In view of limitations of known systems and methods, blower designs for vented enclosures are described. One blower design incorporates an impeller having a plurality of blades. The plurality of blades are pivotably coupled to an impeller body. Air flow between blades is substantially restricted when the blades are in a closed state. Air flow between the blades is permitted when the blades are in an open state. In one embodiment the pivotal couplings are spring loaded to maintain the blades in the closed state when the impeller rotational speed is below a threshold range.

One embodiment of a method for operating a blower includes the step of providing a blower having an impeller with pivotable blades. The blades are maintained in a closed state to restrict reverse air flow while an impeller rotational speed is below a threshold range. The blades are pivoted to an open state to permit air flow when an impeller rotational speed exceeds a threshold range.

In one embodiment, an apparatus includes an enclosure having at least one vent. The apparatus includes a plurality of blowers for exchanging air between the interior and the exterior of the enclosure in co-operation with the vent. Each blower comprises an impeller having pivotable blades. The pivotable blades pivot to permitting substantially no reverse air flow through the blower when the rotational speed of the impeller falls below a threshold range.

In various embodiments, the impellers are configured for centrifugal pumping action. For example, in various embodiments the impeller blades form one of an airfoil, backward inclined, backward curved, radial, paddle, and forward curved configuration.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

In a typical redundant blower system, the system must be designed to adequately accommodate both the loss of pumping ability and the reduction in efficiency due to changed air flow patterns. In a system having multiple blowers specifically to achieve a particular air flow pattern without regard to redundancy, the introduction of a new source (or sink) of air may disrupt the air flow patterns sufficiently to prevent adequate cooling.

Blowers are effectively air pumps formed by a motor having an impeller for a rotor. The impellers comprise a plurality of air moving surfaces such as blades. Blower impellers may be classified as axial flow, centrifugal (i.e., radial) flow, or mixed flow with respect to how the air is moved relative to the axis of rotation of the impeller. The motor and blade designs are driven by the efficiency and power requirements of the application.

Figure 1:
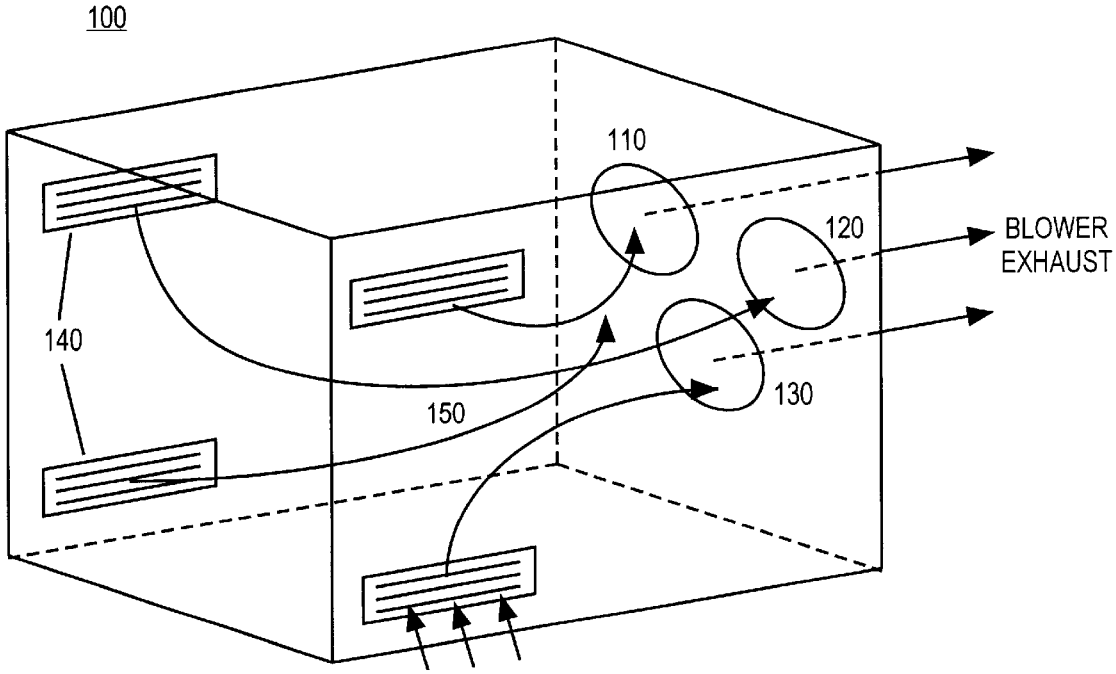
FIG. 1 illustrates one embodiment of air flow patterns in an enclosure utilizing a plurality of blowers for forced air cooling.

FIG. 1 illustrates one embodiment of an equipment enclosure 100 having a plurality of blowers 110, 120, 130 and vents 140. In this embodiment, air flow pattern indicators 150 show that forced air cooling is achieved when air external to the enclosure passes through vents 140 when replacing the air being pumped out of the enclosure by the blowers.

Figure 2:
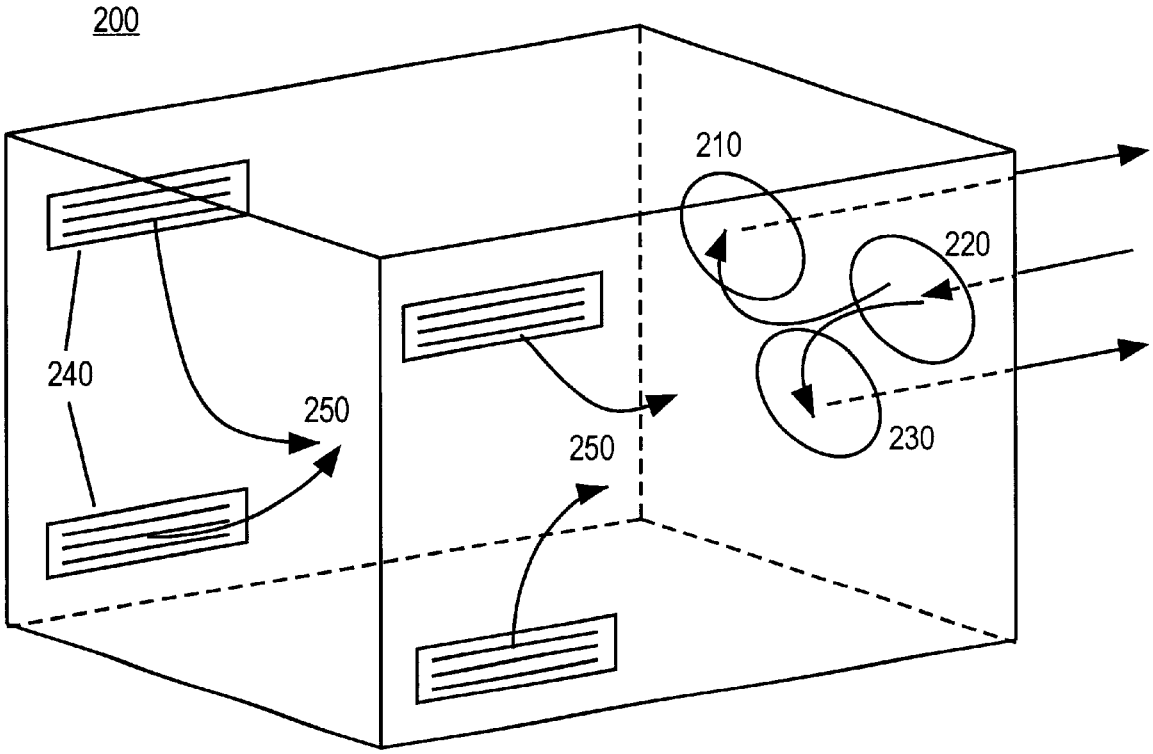
FIG. 2 illustrates one embodiment of air flow patterns in an enclosure having a plurality of blowers including at least one failed blower.

The number and placement of the blowers may have been chosen for the purpose of redundancy or to achieve a specific air flow pattern without regard to the possibility of failure. FIG. 2 illustrates an enclosure 200 with operating blowers 210 and 230 and failed blower 220. The blowers reside at interfaces between the inside and the outside of the enclosure 200 and thus serve as unintended vents in the event of a blower failure. Moreover, these interfaces may serve as a preferential source for air compared to any other vents 240 in the event of failure. The exhaust port of failed blower 220 serves as a preferential air intake compared to vents 240 thus undesirably disrupting the air flow 250 through the enclosure 200.

Figure 3:
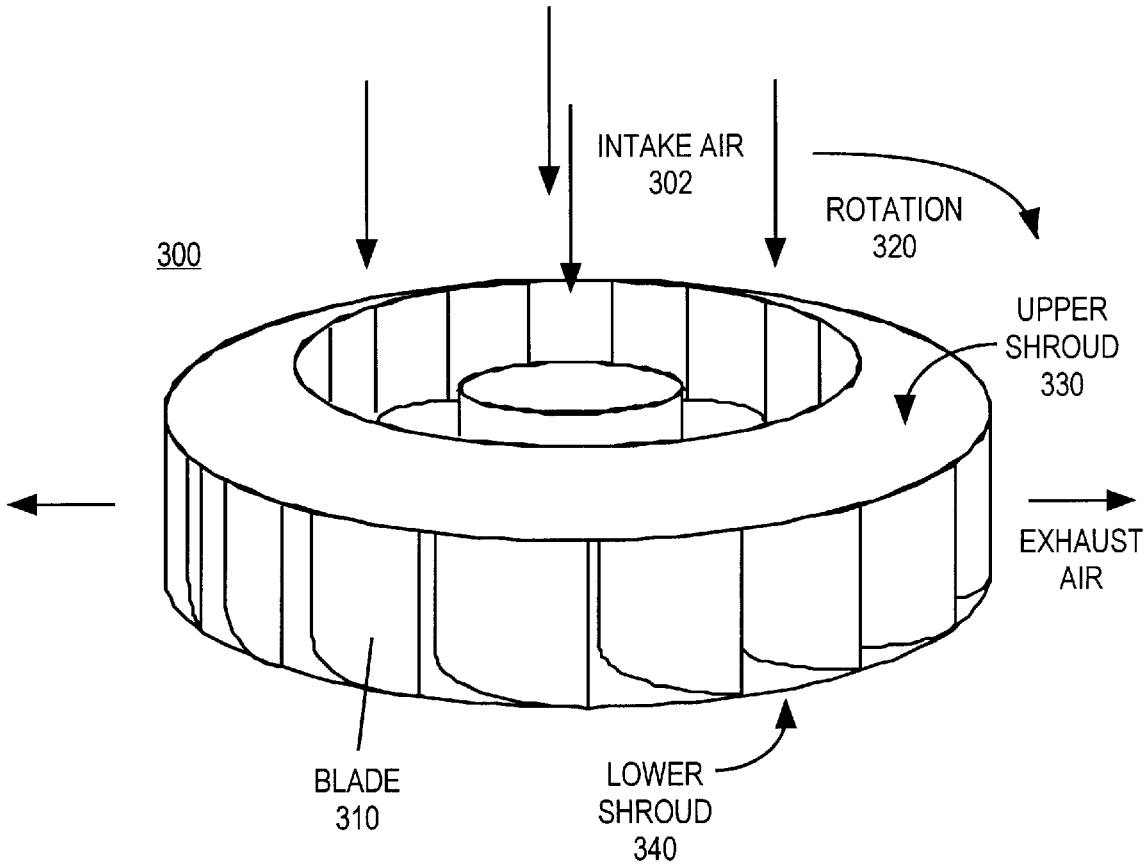
FIG. 3 illustrates one embodiment of an impeller.
Figure 4:
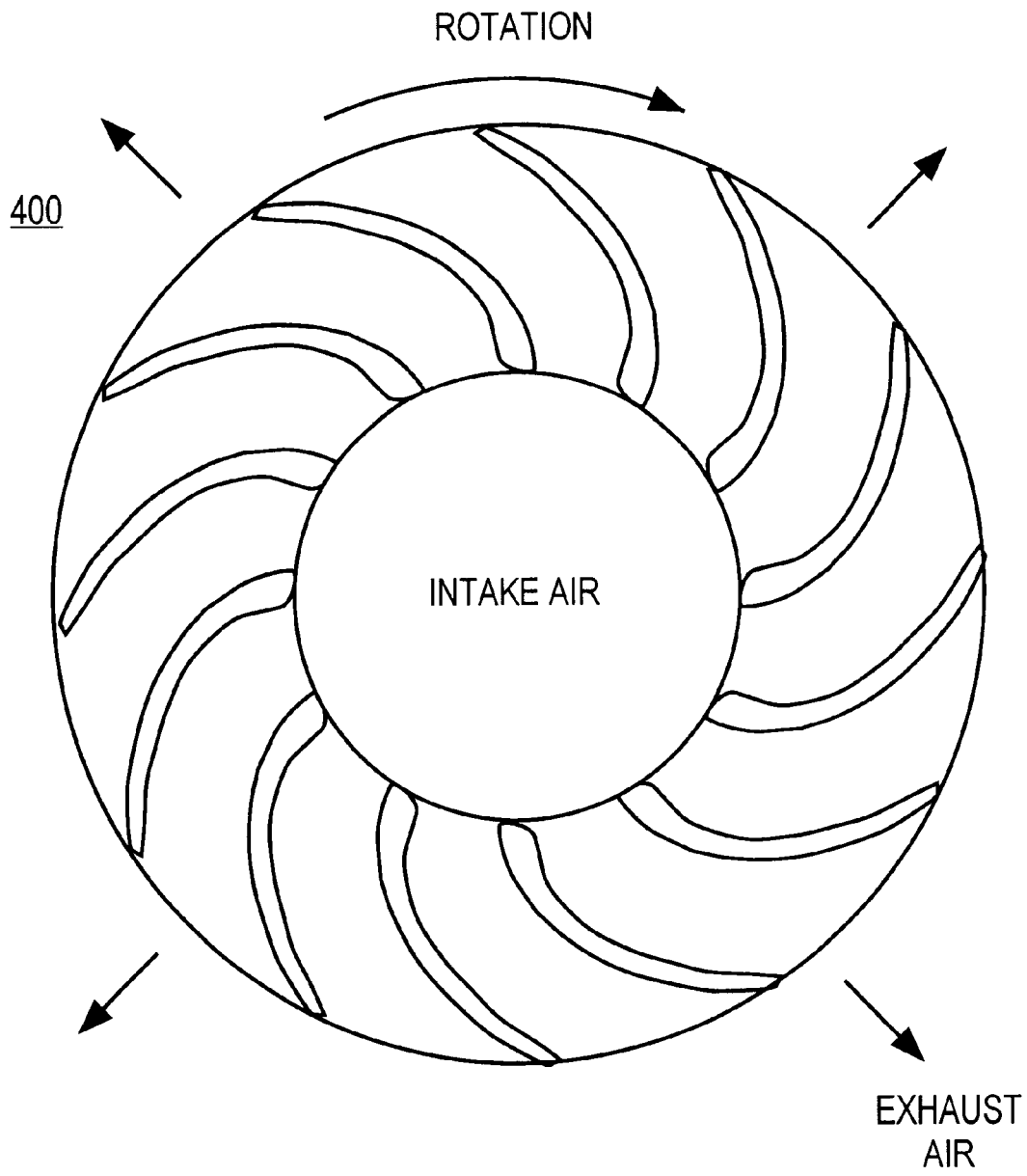
FIG. 4 illustrates a top view of an impeller blade configuration.

FIG. 3 illustrates one embodiment of a centrifugal blower impeller 300. Typical centrifugal impeller blade configurations include airfoil, backward inclined (illustrated), backward curved, radial, paddle, and forward curved. The blades may be attached to a common hub, body, or shroud (e.g., 330, 340). When impeller 300 rotates in a direction indicated by arc 320, air 302 is pulled into the center of the impeller from the source and then forced out between blades 310. The inefficiencies introduced by a failed blower may be significantly decreased through the use of an impeller designed to permit substantial air flow only during operation of the blower. FIG. 4 illustrates a top view of an impeller 400 without an upper shroud to illustrate the blade configuration. Impeller 400 has a backward inclined blade configuration.

Figure 5:
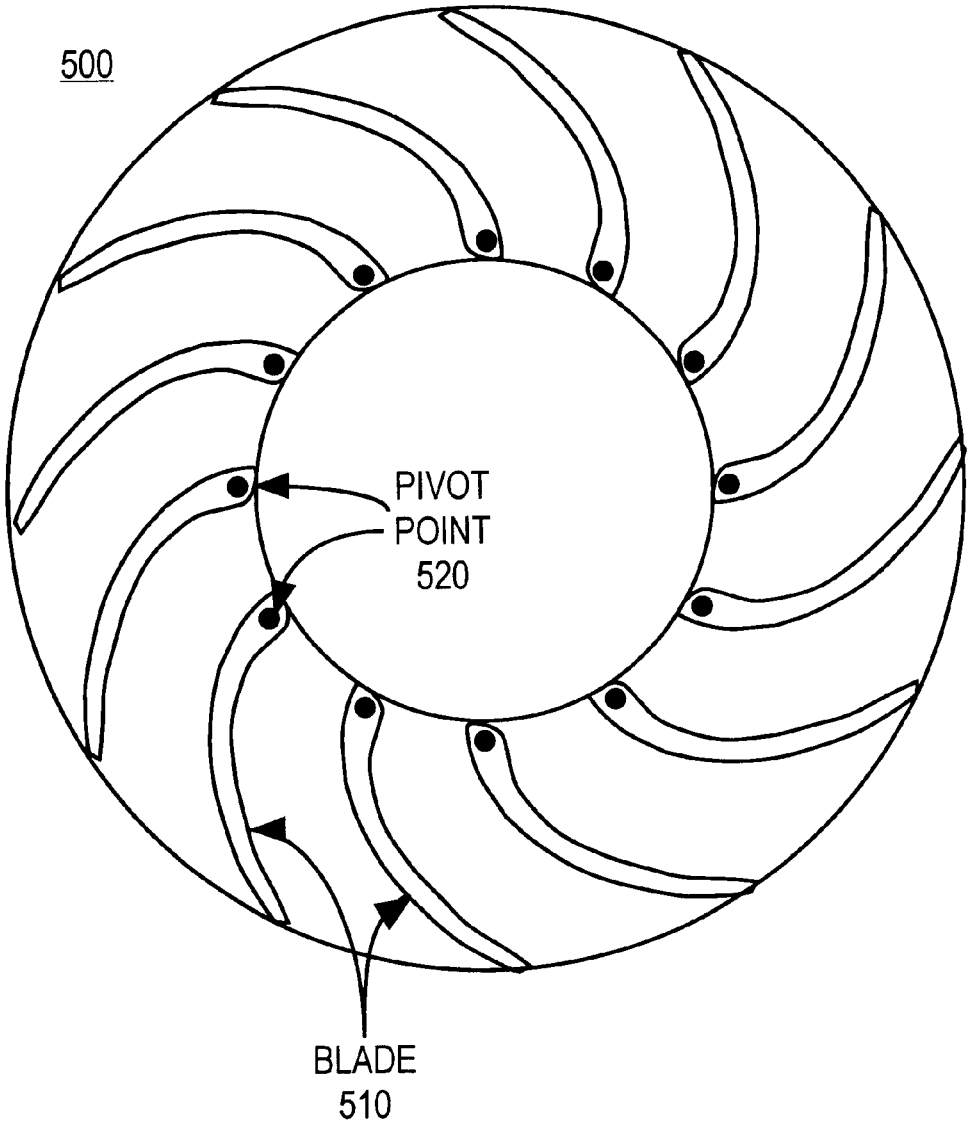
FIG. 5 illustrates one embodiment of a one-way blower impeller in an open state.

FIG. 5 illustrates one embodiment of a centrifugal impeller 500 with modifications to substantially reduce undesirable reverse air flow. Impeller 500 includes a set of blades 510 that pivot on hinges 520. The hinges permit the blades to pivot about an axis substantially parallel to an impeller axis of rotation. In the illustrated embodiment, the blades are hinged near their leading edges. As long as impeller 500 is rotating at a speed above a threshold range, the blades will be in the open state to permit air flow between the blades.

Figure 6:
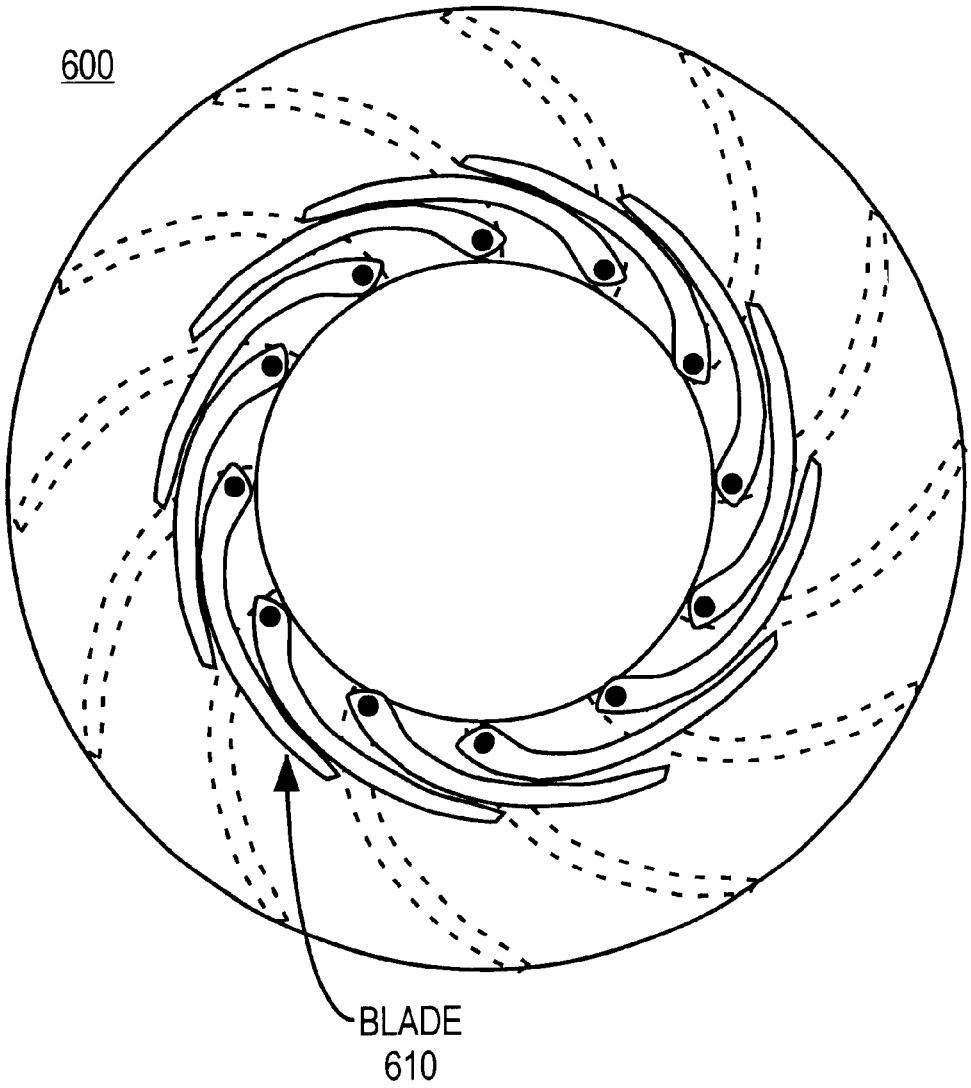
FIG. 6 illustrates one embodiment of a one-way blower impeller in a closed state.

FIG. 6 illustrates the impeller of FIG. 5 when the blades are in a closed state. Unless the impeller is rotating at a speed above a threshold range, the blades will be folded in towards the impeller body to prevent substantial reverse airflow. In the illustrated embodiment, the blades are of sufficient length to partially overlap each other to prevent reverse air flow in the closed state. In an alternative embodiment, the blades do not overlap each other. Instead, the trailing edge of one blade just meets the leading edge of an adjacent blade. Alternatively, the impeller has blocking spacers distributed around the impeller body. In this latter embodiment, each spacer blocks air flow between the leading edge of one blade and the trailing edge of an adjacent blade when the blades are in the closed state. While in the closed state, the blades substantially restrict reverse air flow.

In one embodiment, spring loaded hinges maintain the blades in the closed state until the impeller reaches a sufficient rotational speed. Referring to FIGS. 5–6, when the rotational speed of the closed impeller exceeds the threshold range, the forces of rotation and the pressure differential between the blower intake and exhaust cause the blades to open. When the impeller is rotating with sufficient speed, the impeller opens to permit air flow between the blades. The blades thus act as a speed controlled valve to substantially restrict reverse air flow when the forces due to rotational speed and pressure differentials are insufficient to overcome the natural tendency of the spring loaded hinges to maintain the blades in a closed position.

Applications of the one way impeller include blowers for enclosures designed for any heat generating equipment such as computers, computer peripherals, audiovisual equipment, electronic equipment racks, and generally any other powered equipment.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

an enclosure having at least one vent; and a plurality of blowers for exchanging air between the interior and the exterior of the enclosure in co-operation with the vent, wherein each blower comprises an impeller having pivotable blades permitting substantially no reverse air flow through the blower when the rotational speed of the impeller falls below a threshold range.

2. The impeller of claim 1 wherein each pivotable blade is coupled to an impeller body by a spring loaded pivotable coupling to maintain the blades in a closed state when the impeller rotational speed is below the threshold range, wherein the blades pivot to an open state to permit air flow between the blades when the impeller speed exceeds the threshold range.

3. The impeller of claim 1 wherein each blade partially overlaps an adjacent blade in the closed state.

4. The impeller of claim 1 wherein no blade partially overlaps an adjacent blade in the closed state.

5. The apparatus of claim 1 wherein the blades of at least one impeller are configured for centrifugal pumping action.

6. The impeller of claim 1 wherein the blades form a selected one of an airfoil, backward inclined, backward curved, radial, paddle, and forward curved configuration.

7. An apparatus comprising:

an enclosure having a plurality of interfaces for exchanging air between the interior and exterior of the enclosure; and a plurality of blowers each residing at an associated one of the plurality of interfaces, wherein each blower comprises an impeller having pivotable blades permitting substantially no reverse air flow through its associated interface when a rotational speed of the impeller falls below a threshold range.

8. The impeller of claim 7 wherein each pivotable blade is coupled to an impeller body by a spring loaded pivotable coupling to maintain the blades in a closed state when the impeller rotational speed is below the threshold range, wherein the blades pivot to an open state to permit air flow between the blades when the impeller speed exceeds the threshold range.

9. The impeller of claim 7 wherein each blade partially overlaps an adjacent blade in the closed state.

10. The impeller of claim 7 wherein no blade partially overlaps an adjacent blade in the closed state.

11. The apparatus of claim 7 wherein the blades of at least one impeller are configured for centrifugal pumping action.

12. The impeller of claim 7 wherein the blades form a selected one of an airfoil, backward inclined, backward curved, radial, paddle, and forward curved configuration.

13. An apparatus comprising:

an enclosure having at least one vent and a plurality of interfaces for exchanging air between the interior and exterior of the enclosure; and a plurality of blowers each residing at an associated one of the plurality of interfaces, wherein each blower comprises an impeller having pivotable blades permitting substantially no reverse air flow through its associated interface when a rotational speed of the impeller falls below a threshold range.

14. The impeller of claim 13 wherein each pivotable blade is coupled to an impeller body by a spring loaded pivotable coupling to maintain the blades in a closed state when the impeller rotational speed is below the threshold range, wherein the blades pivot to an open state to permit air flow between the blades when the impeller speed exceeds the threshold range.

15. The impeller of claim 13 wherein each blade partially overlaps an adjacent blade in the closed state.

16. The impeller of claim 13 wherein no blade partially overlaps an adjacent blade in the closed state.

17. The apparatus of claim 13 wherein the blades of at least one impeller are configured for centrifugal pumping action.

18. The impeller of claim 13 wherein the blades form a selected one of an airfoil, backward inclined, backward curved, radial, paddle, and forward curved configuration.

* * * * *